US012252373B2

(12) United States Patent
Arai

(10) Patent No.: US 12,252,373 B2
(45) **Date of Patent: *Mar. 18, 2025**

(54) MEDIUM CONVEYING APPARATUS FOR CONTROLLING CURRENT LIMIT VALUE OF DC MOTOR

(71) Applicant: PFU LIMITED, Kahoku (JP)

(72) Inventor: Yuta Arai, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/516,559

(22) Filed: Nov. 21, 2023

(65) Prior Publication Data

US 2024/0083702 A1 Mar. 14, 2024

Related U.S. Application Data

(63) Continuation of application No. 17/367,954, filed on Jul. 6, 2021, now Pat. No. 11,866,290.

(30) Foreign Application Priority Data

Jul. 17, 2020 (JP) ..... 2020-123115

(51) Int. Cl.

| | |
|---|---|
| ***B65H 7/02*** | (2006.01) |
| ***B65H 5/06*** | (2006.01) |
| ***B65H 7/18*** | (2006.01) |

(52) U.S. Cl.

CPC ..... *B65H 7/02* (2013.01); *B65H 5/062* (2013.01); *B65H 7/18* (2013.01); *B65H 2511/13* (2013.01);

(Continued)

(58) Field of Classification Search

CPC .... B65H 3/063; B65H 3/0661; B65H 3/0669; B65H 5/06; B65H 5/062; B65H 7/02;

(Continued)

(56) References Cited

U.S. PATENT DOCUMENTS

2003/0184002 A1 10/2003 Akiyama et al.
2011/0243627 A1* 10/2011 Liao ..... B65H 7/00 271/4.01

(Continued)

FOREIGN PATENT DOCUMENTS

JP 2003-291433 A 10/2003
JP 2005-335302 A 12/2005

(Continued)

*Primary Examiner* — Prasad V Gokhale
(74) *Attorney, Agent, or Firm* — WOMBLE BOND DICKINSON (US) LLP

(57) ABSTRACT

A medium conveying apparatus includes a conveyance roller to convey a medium, an imaging device to image the medium, a DC motor to drive the conveyance roller, a processor to detect that a front end of the medium reaches between the conveyance roller and the imaging device, set a current limit value of the DC motor to a first limit value until the front end of the medium reaches between the conveyance roller and the imaging device, and change the current limit value to a second limit value larger than the first limit value after the front end of the medium has reached between the conveyance roller and the imaging device, and drive the conveyance roller by rotating the DC motor based on the second limit value when the imaging device performs imaging.

20 Claims, 12 Drawing Sheets

(52) U.S. Cl.
CPC ..... *B65H 2515/70* (2013.01); *B65H 2553/30* (2013.01)

(58) Field of Classification Search
CPC ..... B65H 7/14; B65H 7/18; B65H 2511/13; B65H 2513/10; B65H 2513/11; B65H 2515/70; B65H 2553/30
See application file for complete search history.

(56) References Cited

U.S. PATENT DOCUMENTS

| | | | | |
|---|---|---|---|---|
| 2016/0124687 | A1 | 5/2016 | Shinagawa et al. | |
| 2019/0127168 | A1* | 5/2019 | Miyajima | B65H 7/02 |
| 2020/0247629 | A1* | 8/2020 | Iino | B65H 9/006 |
| 2021/0107753 | A1* | 4/2021 | Fujii | B65H 3/047 |

FOREIGN PATENT DOCUMENTS

| | | | |
|---|---|---|---|
| JP | 2010-259279 | A | 11/2010 |
| JP | 2016-087812 | A | 5/2016 |
| JP | 2018-2346 | A | 1/2018 |

* cited by examiner

MEDIUM CONVEYING APPARATUS FOR CONTROLLING CURRENT LIMIT VALUE OF DC MOTOR

CROSS-REFERENCE TO RELATED APPLICATIONS

This application is a continuation application of U.S. patent application Ser. No. 17/367,954, filed Jul. 6, 2021, which claims priority to and benefit of prior Japanese Patent Application No. 2020-123115, filed on Jul. 17, 2020, the entire contents of which are incorporated herein by reference.

TECHNICAL FIELD

Embodiments discussed in the present specification relate to medium conveyance.

BACKGROUND

In a medium conveying apparatus such as a scanner, a DC (Direct Current) motor may be used as a motor to convey a medium. A cost of the DC motor is low and the DC motor can easily adjust the speed. However, a magnitude of a required current varies by an external factor such as a load variation. In general, since the medium conveying apparatus is supplied with a power using an AC (Alternating Current) adapter, the medium conveying apparatus has a limit to a supply capacity. Therefore, the medium conveying apparatus to convey the medium using the DC motor needs to appropriately control the magnitude of the current used by the DC motor.

A paper feeding apparatus to drive a DC motor by a PWM signal having a fixed duty in a first predetermined section to perform a paper feeding operation, and to feed paper by position feedback control when a front end of the paper is detected by the registration sensor, is disclosed (Japanese Unexamined Patent Application Publication (Kokai) No. 2003-291433).

SUMMARY

According to some embodiments, a medium conveying apparatus includes a conveyance roller to convey a medium, an imaging device to image the medium, a DC motor to drive the conveyance roller, a processor to detect that a front end of the medium reaches between the conveyance roller and the imaging device, set a current limit value of the DC motor to a first limit value until the front end of the medium reaches between the conveyance roller and the imaging device, and change the current limit value to a second limit value larger than the first limit value after the front end of the medium has reached between the conveyance roller and the imaging device, and drive the conveyance roller by rotating the DC motor based on the second limit value when the imaging device performs imaging.

According to some embodiments, a method for controlling conveying a medium includes conveying a medium by a conveyance roller, imaging the medium by an imaging device, driving the conveyance roller by a DC motor, detecting that a front end of the medium reaches between the conveyance roller and the imaging device, setting a current limit value of the DC motor to a first limit value until the front end of the medium reaches between the conveyance roller and the imaging device, and changing the current limit value to a second limit value larger than the first limit value after the front end of the medium has reached between the conveyance roller and the imaging device, and driving the conveyance roller by rotating the DC motor based on the second limit value when the imaging device performs imaging.

According to some embodiments, a computer-readable, non-transitory medium stores a computer program. The computer program causes a medium conveying apparatus including a conveyance roller to convey a medium, an imaging device to image the medium, and a DC motor to drive the conveyance roller, to execute a process including detecting that a front end of the medium reaches between the conveyance roller and the imaging device, setting a current limit value of the DC motor to a first limit value until the front end of the medium reaches between the conveyance roller and the imaging device, and changing the current limit value to a second limit value larger than the first limit value after the front end of the medium has reached between the conveyance roller and the imaging device, and driving the conveyance roller by rotating the DC motor based on the second limit value when the imaging device performs imaging.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
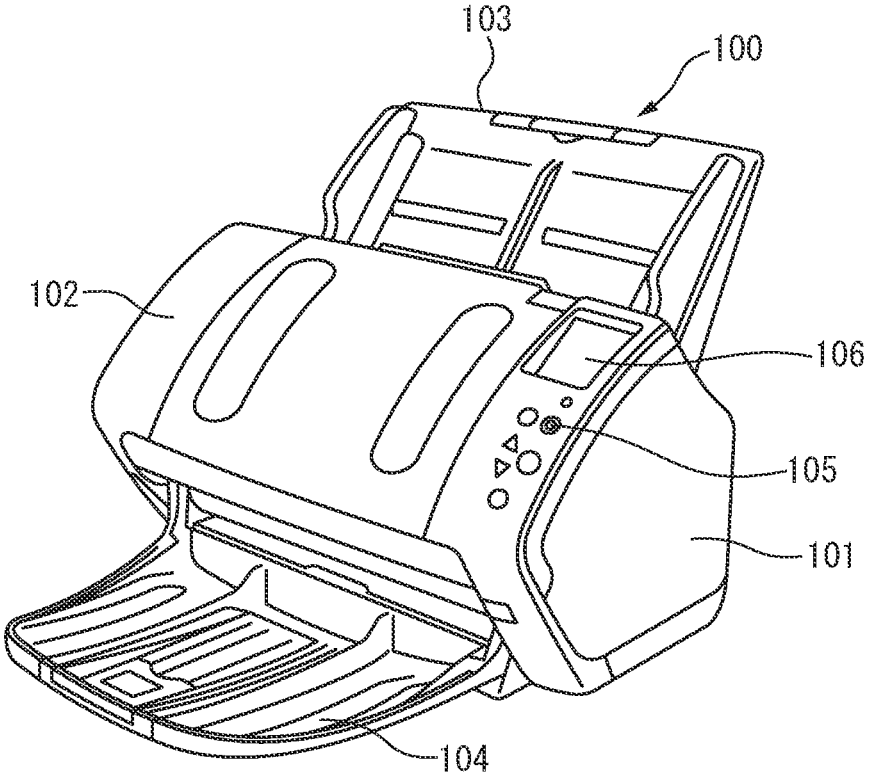
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. The medium is a thin medium, such as a paper, or a thick medium, such as a thick paper, a card, a booklet or a passport. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

The medium tray 103 is engaged with the lower housing 101 in such a way as to be able to place a medium to be conveyed. The ejection tray 104 is engaged with the lower housing 101 in such a way as to be able to hold an ejected medium. The ejection tray 104 is foldably provided so as to face a front surface of the medium conveying apparatus 100 (upper housing 102).

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
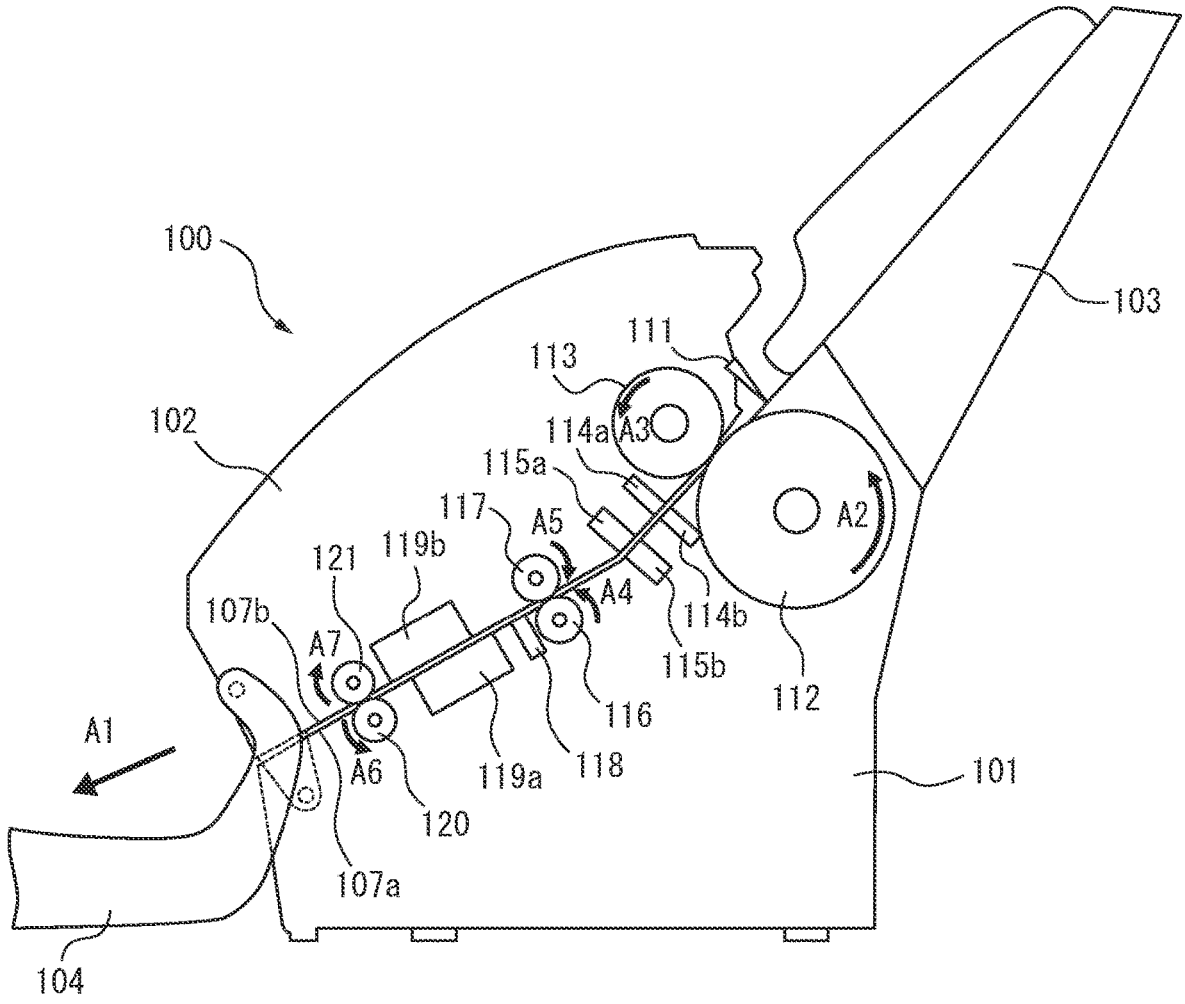
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes a first medium sensor 111, a feed roller 112, a brake roller 113, a thickness sensor light emitter 114*a*, a thickness sensor light receiver 114*b*, an ultrasonic transmitter 115*a*, an ultrasonic receiver 115*b*, a first conveyance roller 116, a second conveyance roller 117, a second medium sensor 118, a first imaging device 119*a*, a second imaging device 119*b*, a third conveyance roller 120 and a fourth conveyance roller 121, etc. The number of each roller is not limited to one, and may be plural. Hereinafter, the first imaging device 119*a* and the second imaging device 119*b* may be collectively referred to as an imaging device 119.

A top surface of the lower housing 101 forms a lower guide 107*a* of a conveyance path of a medium, and a bottom surface of the upper housing 102 forms an upper guide 107*b* of the conveyance path of a medium. An arrow A1 in FIG. 2 indicates a medium conveying direction. Hereinafter, an upstream refers to an upstream in the medium conveying direction A1, and a downstream refers to a downstream in the medium conveying direction A1.

The first medium sensor 111 is located on an upstream side of the feed roller 112 and the brake roller 113. The first medium sensor 111 includes a contact detection sensor and detects whether or not a medium is placed on the medium tray 103. The first medium sensor 111 generates and outputs a medium detection signal changing the signal value between a state in which a medium is placed on the medium tray 103 and a state in which a medium is not placed.

The feed roller 112 and the brake roller 113 are provided on an upstream side of the first conveyance roller 116 and the second conveyance roller 117 in the medium conveying direction A1. The feed roller 112 is provided on the lower housing 101 and sequentially feed media placed on the medium tray 103 from the lower side. The brake roller 113 is provided in the upper housing 102 and is located to face the feed roller 112.

The thickness sensor light emitter 114*a* and the thickness sensor light receiver 114*b* are located on a downstream side of the feed roller 112 and the brake roller 113 and on an upstream side of the first conveyance roller 116 and the second conveyance roller 117. The thickness sensor light emitter 114*a* and the thickness sensor light receiver 114*b* are located close to the medium conveyance path in such a way as to face one another with the conveyance path in between. The thickness sensor light emitter 114*a* is a light emitting diode (LED), etc., and emits light toward the medium conveyance path. On the other hand, the thickness sensor light receiver 114*b* receives light emitted by the thickness sensor light emitter 114*a* and passed through the conveyed medium, to generate and output a thickness signal that is an electrical signal corresponding to an intensity (light quantity) of the received light. Hereinafter, the thickness sensor light emitter 114*a* and the thickness sensor light receiver 114*b* may be collectively referred to as a thickness sensor 114.

When a medium exists between the thickness sensor emitter 114*a* and the thickness sensor receiver 114*b*, the light emitted by the emitter is attenuated by the medium. As the thickness of the medium is larger, the light emitted by the thickness sensor light emitter 114*a* is shielded by the medium, an amount of light received by the thickness sensor light receiver 114*b* is smaller, and a signal value of the thickness signal is smaller. On the other hand, as the thickness of the medium is smaller, the light emitted by the thickness sensor light emitter 114*a* passes through the medium, the amount of light received by the thickness sensor light receiver 114*b* is larger, and the signal value of the thickness signal is larger. When there is no medium between the thickness sensor light emitter 114*a* and the thickness sensor light receiver 114*b*, the light emitted by the thickness sensor light emitter 114*a* reaches the thickness sensor light receiver 114*b* without being blocked at all. Therefore, the signal value of the thickness signal in this case is larger than that in the case where an extremely thin medium exists between the thickness sensor light emitter 114*a* and the thickness sensor light receiver 114*b*. That is, the thickness sensor 114 detects the thickness of the conveyed medium, as well as determining whether or not the medium exists at the position, based on the amount of light received by the thickness sensor light receiver 114*b*.

A means other than the thickness sensor light emitter 114*a* and the thickness sensor light receiver 114*b* may be used as the thickness sensor 114. For example, a reflected light sensor, a pressure sensor or a mechanical sensor may be used as the thickness sensor 114. The reflected light sensor detects a time from irradiating light to a surface of the medium until receiving a reflected light, to generate a signal corresponding to a length of the detected time as the thickness signal. The pressure sensor detects a pressure which changes according to a paper thickness of the medium, to generate a signal corresponding to a magnitude of the detected pressure as the thickness signal. The mechanical sensor detects an amount of movement of a roller in contact with the medium, to generate a signal corresponding to the detected amount of movement as the thickness signal.

The ultrasonic transmitter 115*a* and the ultrasonic receiver 115*b* are located on the downstream side of the feed roller 112 and the brake roller 113 and on the upstream side of the first conveyance roller 116 and the second conveyance roller 117. The ultrasonic transmitter 115*a* and the ultrasonic receiver 115*b* are located close to the conveyance path of a medium in such a way as to face one another with the conveyance path in between. The ultrasonic transmitter 115*a* is capable of outputting an ultrasonic wave. On the other hand, the ultrasonic receiver 115*b* receives an ultrasonic wave being transmitted by the ultrasonic transmitter 115*a* and passing through a medium, and generates and outputs an ultrasonic signal being an electric signal corresponding to the received ultrasonic wave. The ultrasonic transmitter 115*a* and the ultrasonic receiver 115*b* may be hereinafter collectively referred to as an ultrasonic sensor 115.

The first conveyance roller 116 is provided on the lower housing 101. The second conveyance roller 117 is provided in the upper housing 102, and is located to face the first conveyance roller 116. The first conveyance roller 116 and the second conveyance roller 117 are examples of a conveyance roller, and are provided on the downstream side of the feed roller 112 and the brake roller 113 in the medium conveying direction A1. The first conveyance roller 116 and the second conveyance roller 117 conveys the medium fed by the feed roller 112 and the brake roller 113 to the imaging device 119.

The second medium sensor 118 is located on the downstream side of the first conveyance roller 116 and the second conveyance roller 117 and on the upstream side of the imaging device 119 in the medium conveying direction A1. The second medium sensor 118 detects whether or not the medium exists at the second medium sensor 115. The second medium sensor 118 includes a light emitter and a light receiver provided on one side with respect to the conveyance path of the medium, and a reflection member such as a mirror provided at a position facing the light emitter and the light receiver across the conveyance path. The light emitter emits light toward the conveyance path. On the other hand, the light receiver receives light emitted by the light emitter and reflected by the reflection member, to generate and output a second medium signal being an electric signal based on intensity of the received light. Since the light emitted by the light emitter is shielded by the medium when the medium exists at the position of the second medium sensor 118, a signal value of the second medium signal is changed in a state in which the medium exists at the position of the second medium sensor 118 and a state in which a medium does not exist at the position. The light emitter and the light receiver may be provided at positions facing one another with the conveyance path in between, and the reflection member may be omitted.

The first imaging device 119*a* includes a line sensor based on a unity-magnification optical system type contact image sensor (CIS) including an imaging element based on a complementary metal oxide semiconductor (CMOS) linearly located in a main scanning direction. Further, the first imaging device 119*a* includes a lens for forming an image on the imaging element, and an A/D converter for amplifying and analog-digital (A/D) converting an electric signal output from the imaging element. The first imaging device 119*a* generates and outputs an input image by imaging a front side of a conveyed medium, in accordance with control from a processing circuit to be described later.

Similarly, the second imaging device 119*b* includes a line sensor based on a unity-magnification optical system type CIS including an imaging element based on a CMOS linearly located in a main scanning direction. Further, the second imaging device 119*b* includes a lens for forming an image on the imaging element, and an A/D converter for amplifying and A/D converting an electric signal output from the imaging element. The second imaging device 119*b* generates and outputs an input image by imaging a back side of a conveyed medium, in accordance with control from a processing circuit to be described later.

The first imaging device 119*a* and the second imaging device 119*b* are examples of an imaging device. Only either of the first imaging device 119*a* or the second imaging device 119*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

A medium placed on the medium tray 103 is conveyed between the lower guide 107*a* and the upper guide 107*b* in the medium conveying direction A1 by the feed roller 112 rotating in a direction of an arrow A2 in FIG. 2. When a medium is conveyed, the brake roller 113 rotates in a direction of an arrow A3. By the workings of the feed roller 112 and the brake roller 113, when a plurality of media are placed on the medium tray 103, only a medium in contact with the feed roller 112, out of the media placed on the medium tray 103, is separated. Consequently, the medium conveying apparatus 100 operates in such a way that conveyance of a medium other than the separated medium is restricted (prevention of multi-feed).

The medium is fed between the first conveyance roller 116 and the second conveyance roller 117 while being guided by the lower guide 107*a* and the upper guide 107*b*. The medium is fed between the first imaging device 119*a* and the second imaging device 119*b* by the first conveyance roller 116 and the second conveyance roller 117 rotating in directions of an arrow A4 and an arrow A5, respectively. The medium read by the imaging device 119 is ejected on the ejection tray 104 by the third conveyance roller 121 and the fourth conveyance roller 122 rotating in directions of an arrow A6 and an arrow A7, respectively.

Figure 3:
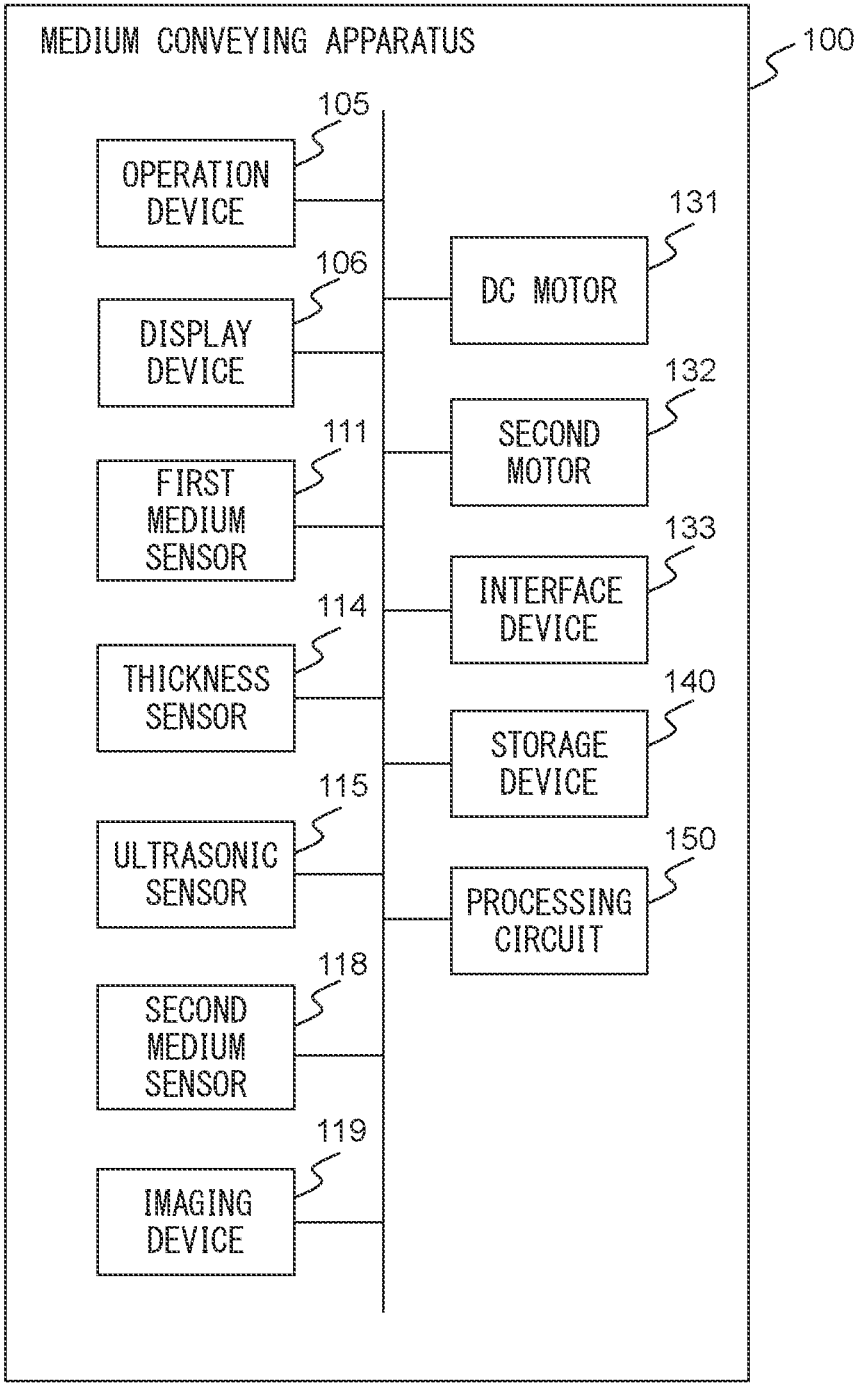
FIG. 3 is a block diagram illustrating a schematic configuration of the medium conveying apparatus 100.

FIG. 3 is a block diagram illustrating a schematic configuration of the medium conveying apparatus 100.

The medium conveying apparatus 100 further includes a DC motor 131, a second motor 132, an interface device 133, a storage device 140, a processing circuit 150, etc., in addition to the configuration described above.

The DC motor 131 drives and rotates the first to fourth conveyance rollers 116, 117, 120 and 121 to convey the medium by a control signal from the processing circuit 150. The DC motor 131 may drive only some of the rollers including at least the first conveyance roller 116 or the second conveyance roller 117 among the first to fourth conveyance rollers 116, 117, 120 and 121. In that case, the other conveyance roller is driven by the second motor 132. The DC motor 131 may also drive and rotate the feed roller 112 and/or the brake roller 113 to feed the medium.

The DC motor 131 includes a modulation circuit for PWM (Pulse Width Modulation) modulating a predetermined voltage so as to be a speed specified by the processing circuit 150, and rotates according to the voltage acquired by PWM demodulation by the modulation circuit. The DC motor 131 controls a magnitude of the current flowing through a coil so as to rotate at a constant speed regardless of a magnitude of a load applied to the DC motor 131, which varies depending on a type or a state of the medium conveyed by the first to fourth conveyance rollers 116, 117, 120 and 121. Further, DC motor 131 includes a known control circuit capable of changing a current limit value which is an upper limit value of the current flowing through the coil, to change the current limit value in accordance with the control signal from the processing circuit 150.

The second motor 132 drives and rotates the feed roller 112 and the brake roller 113 to feed the medium by a control signal from the processing circuit 150. The second motor 132 is a stepping motor. The second motor 132 may be a DC motor. The feed roller 112 and the brake roller 113 may also be driven by separate motors.

For example, the interface device 133 includes an interface circuit conforming to a serial bus such as universal serial bus (USB), is electrically connected to an unillustrated information processing apparatus (for example, a personal computer or a mobile information terminal), and transmits and receives an input image and various types of information. Further, a communication module including an antenna transmitting and receiving wireless signals, and a wireless communication interface device for transmitting and receiving signals through a wireless communication line in conformance with a predetermined communication protocol may be used in place of the interface device 133. For example, the predetermined communication protocol is a wireless local area network (LAN).

The storage device 140 includes a memory device such as a random access memory (RAM) or a read only memory (ROM), a fixed disk device such as a hard disk, or a portable storage device such as a flexible disk or an optical disk. Further, the storage device 140 stores a computer program, a database, a table, etc., used for various types of processing in the medium conveying apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The processing circuit 150 operates in accordance with a program previously stored in the storage device 140. The processing circuit 170 is, for example, a CPU (Central Processing Unit). The processing circuit 150 may be a digital signal processor (DSP), a large scale integration (LSI), an application specific integrated circuit (ASIC), a field-programmable gate array (FPGA), etc.

The processing circuit 150 is connected to the operation device 105, the display device 106, the first medium sensor 111, the thickness sensor 114, the ultrasonic sensor 115, the second medium sensor 118, the imaging device 119, the DC motor 131, the second motor 132, the interface device 133 and the storage device 140, etc., to control each module. The processing circuit 150 drives the DC motor 131 and the second motor 132 to cause each roller to convey the medium, acquires the input image from the imaging device 119, and transmits it to the information processing apparatus via the interface device 133. In particular, the processing circuit 150 changes the current limit value of the DC motor 131 based on the second medium signal received from the second medium sensor 118.

Figure 4:
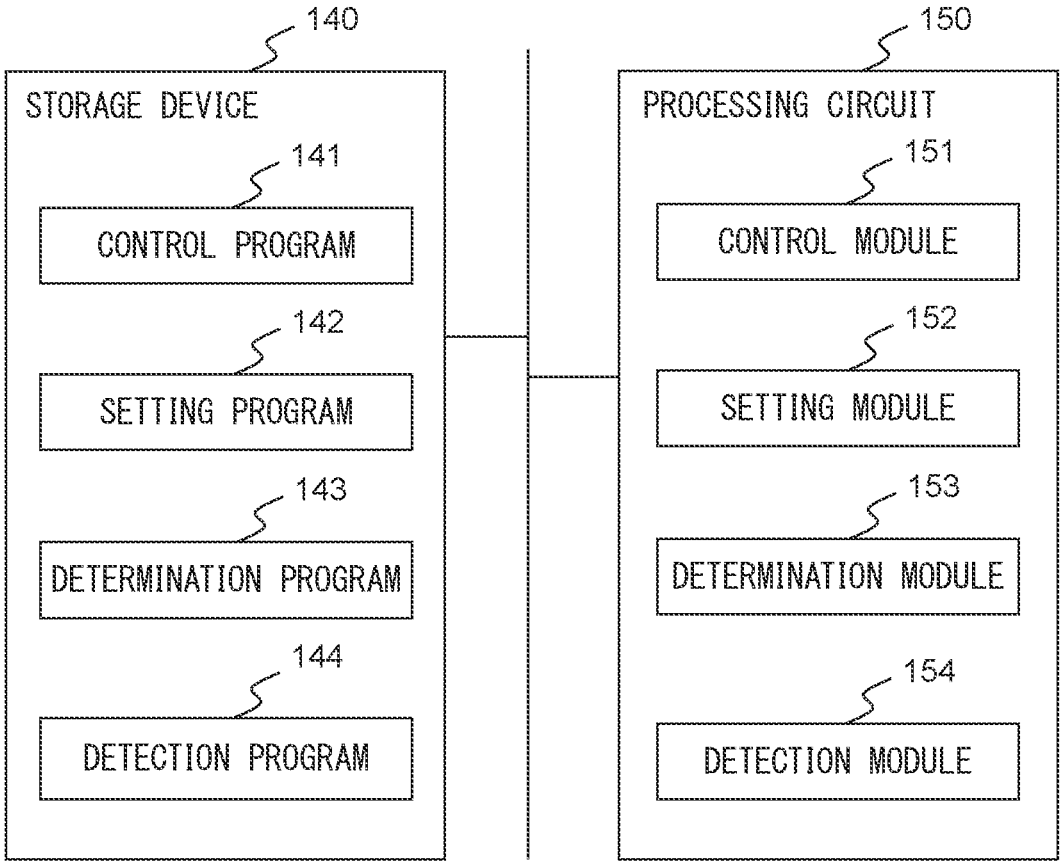
FIG. 4 is a diagram illustrating schematic configurations of a storage device 140 and a processing circuit 150.

FIG. 4 is a diagram illustrating schematic configurations of a storage device 140 and a processing circuit 150.

As shown in FIG. 4, the storage device 140 stores a control program 141, a setting program 142, a determination program 143, a detection program 144, etc. Each of these programs is a functional module implemented by software operating on a processor. The processing circuit 150 reads each program stored in the storage device 140 and operates in accordance with each read program. Consequently, the processing circuit 150 functions as a control module 151, a setting module 152, a determination module 153 and a detection module 154.

Figure 5:
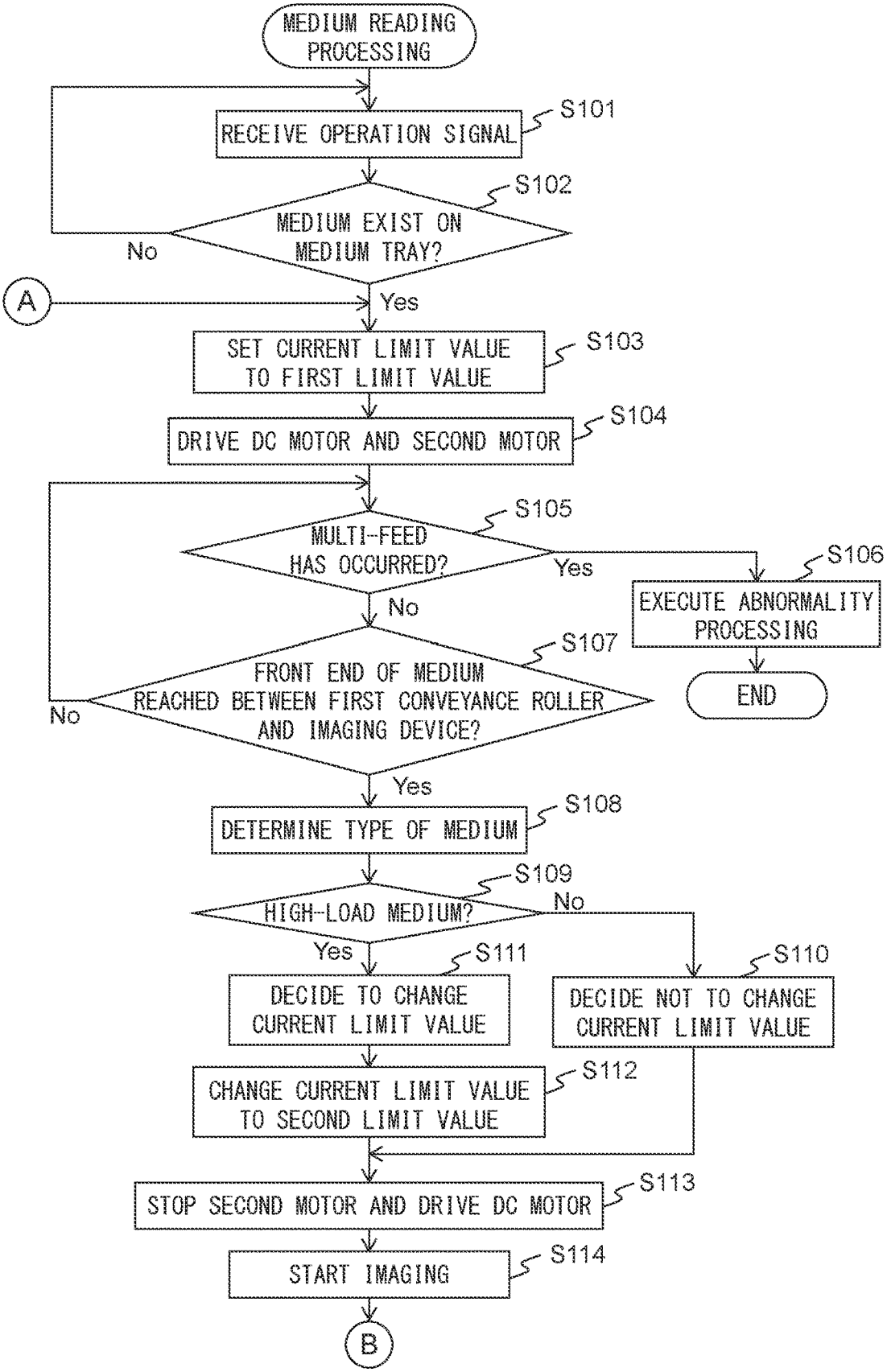
FIG. 5 is a flowchart illustrating an operation example of a medium reading processing.
Figure 6:
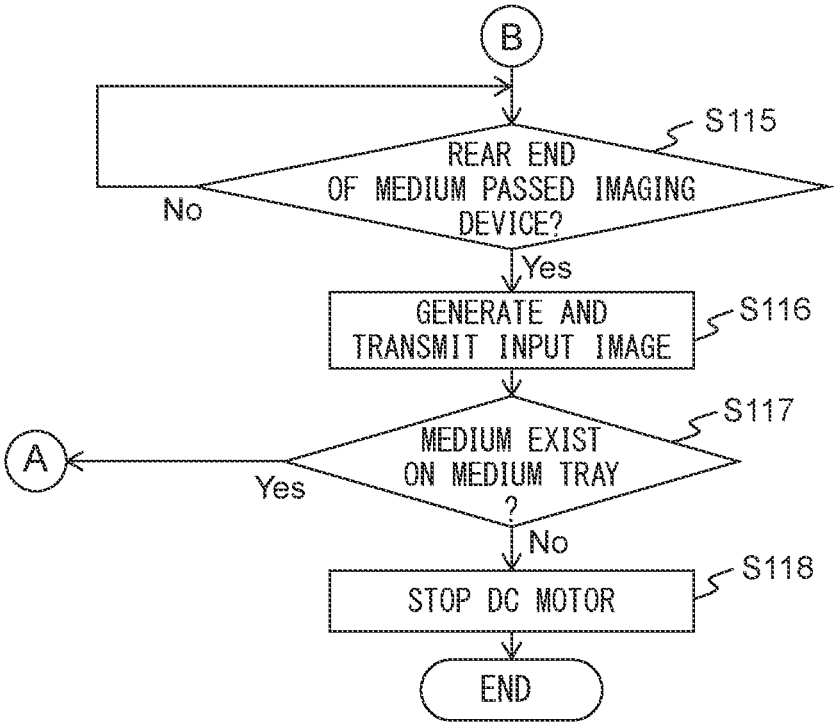
FIG. 6 is a flowchart illustrating an operation example of the medium reading processing.

FIGS. 5 and 6 are flowcharts illustrating an operation example of a medium reading processing of the medium conveying apparatus 100.

Referring to the flowchart illustrated in FIGS. 5 and 6, the operation example of the medium reading processing in the medium conveying apparatus 100 will be described below. The operation flow described below is executed mainly by the processing circuit 150 in cooperation with each element in the medium conveying apparatus 100, in accordance with a program previously stored in the storage device 140. The flow of operation shown in FIGS. 5 and 6 is executed periodically.

First, the control module 151 stands by until an instruction to read a medium is input by a user by use of the operation device 105, and an operation signal instructing to read the medium is received from the operation device 105 (step S101).

Next, the control module 151 acquires the first medium signal from the first medium sensor 111, and determines whether or not a medium is placed on the medium tray 103, based on the acquired first medium signal (step S102).

When a medium is not placed on the medium tray 103, the control module 151 returns the processing to step S101 and stands by until newly receiving an operation signal from the operation device 105.

On the other hand, when the medium is placed on the medium tray 103, the setting module 152 sets the current limit value of the DC motor 131 to the first limit value (step S103). The first limit value is preset to a magnitude of the current so that a value acquired by adding a margin to a sum of a power consumption of the DC motor 131 and a power consumption of the second motor 132 when driving the DC motor 131 by the current of the magnitude, does not exceed a rated power consumption of the medium conveying apparatus 100.

Next, the control module 151 drives and rotates the second motor 132 to rotate the feed roller 112 and the brake roller 113 to feed the medium. Further, the control module 151 drives and rotates the DC motor 131 to rotate the first to fourth conveyance rollers 116, 117, 120 and 121 to convey the medium (step S104).

The control module 151 performs a feedback control of the DC motor 131, so that the rotational speed of the DC motor 131 follows the command value such as a preset voltage value. Although, the DC motor 131 can easily perform the speed adjustment at a low cost, the rotational speed of the DC motor 131 varies by an external factor such as a load variation. However, the rotational speed of the DC motor 131 changes a rotational speed corresponding to the command value after a predetermined cycle, by the above feedback control. Further, the control module 151 rotates the DC motor 131 to drive the first to fourth conveyance rollers 116, 117, 120 and 121 based on the first limit value set as the current limit value in step S103 so that the magnitude of the current flowing through the coil does not exceed the first limit value. Thus, the control module 151 can appropriately control the magnitude of the current used by the DC motor 131, and appropriately limit the power consumption of the medium conveying apparatus 100.

Next, the determination module 153 determines whether or not the multi-feed of the medium has occurred (step S105). The determination module 153 acquires an ultrasonic signal from the ultrasonic sensor 115, and determines whether or not a signal value of the acquired ultrasonic signal is less than the multi-feed threshold value. The multi-feed threshold value is set to a value between a signal value of an ultrasonic signal when a sheet of paper is conveyed and a signal value of an ultrasonic signal when a multi-feed of paper has occurred. The determination module 153 determines that the multi-feed of the medium has not occurred when the signal value of the ultrasonic signal is equal to or more than the multi-feed threshold value, and it determines that the multi-feed of the medium has occurred when the signal value of the ultrasonic signal is less than the multi-feed threshold value.

When the determination module 153 determines that the multi-feed of the medium has occurred, the control module 151 executes an abnormality processing (step S106), and ends the series of steps. The control module 151 stops the DC motor 131 and the second motor 132, to stop the feeding and conveying of the medium, as the abnormality processing. Further, the control module 151 notifies the user of a warning by displaying information indicating that an abnormality has occurred on the display device 106 or transmitting the information to the information processing apparatus via the interface device 133, as the abnormality processing. The medium conveying apparatus 100 has a separation mode for feeding by separating a plurality of media, and a non-separation mode for feeding without separating the medium, as a feeding mode for feeding the medium. When the feeding mode is set to non-separation mode, the processes of S105 to S106 are omitted.

On the other hand, when the determination module determines that the multi-feed of the medium has not occurred, the detection module 154 determines whether or not the front end of the medium has reached between the first conveyance roller 116 and the second conveyance roller 117, and the imaging device 119 (step S107). The detection module 154 acquires the second medium signal periodically from the second medium sensor 118 and determines whether or not the medium exists at the position of the second medium sensor 118, based on the acquired second medium signal. The detection module 154 determines that the front end of the medium has reached between the first conveyance roller 116 and the second conveyance roller 117, and the imaging device 119 when the signal value of the second medium signal changes from a value indicating that there is no medium to a value indicating that a medium exists. Thus, the detection module 154 detects that the front end of the medium reaches between the first conveyance roller 116 and the second conveyance roller 117, and the imaging device 119.

The detection module 154 may acquire a thickness signal periodically from the thickness sensor 114, and determine whether or not the front end of the medium has reached between the first conveyance roller 116 and the second conveyance roller 117, and the imaging device 119, based on the acquired thickness signal. In that case, the detection module 154 determines that the front end of the medium has reached between the first conveyance roller 116 and the second conveyance roller 117, and the imaging device 119 when a predetermined time has elapsed after the signal value of the thickness signal changes from a value indicating that there is no medium to a value indicating that a medium exists. Alternatively, the detection module 154 may determine that the front end of the medium has reached between the first conveyance roller 116 and the second conveyance roller 117, and the imaging device 119 when a predetermined time has elapsed after the start of feeding of the medium.

When the front end of the medium has not reached between the first conveyance roller 116 and the second conveyance roller 117, and the imaging device 119, the processing circuit 150 returns the process to step S105, and repeats the processes of steps S105 to S107.

On the other hand, when the front end of the medium has reached between the first conveyance roller 116 and the second conveyance roller 117, and the imaging device 119, the determination module 153 determines a type of conveyed medium (step S108). The determination module 153 determines the type of the conveyed medium based on the thickness of the medium detected by the thickness sensor 114. The determination module 153 acquires the thickness signal from the thickness sensor 114. The medium conveying apparatus 100 stores in advance a table in which a signal value of the thickness signal and the type of the medium are associated with each other in the storage device 140, and the determination module 153 specifies the type of the medium corresponding to the thickness signal acquired from the thickness sensor 114 with reference to the table. As the type of the medium, for example, a paper, a thick paper, a plastic card, a booklet, a passport, etc., is set in the order in which the thickness of the medium is small. The determination module 153 can determine the type of the conveyed medium with high accuracy, by utilizing the thickness of the medium.

The determination module 153 may determine the type of the conveyed medium, based on the ultrasonic signal generated by the ultrasonic sensor 115. The determination module 153 acquires an ultrasonic signal from the ultrasonic sensor 115. The medium conveying apparatus 100 stores in advance a table in which the signal value of the ultrasonic signal and the type of the medium are associated with each other in the storage device 140, and the determination module 153 specifies the type of the medium corresponding to the ultrasonic signal acquired from the ultrasonic sensor 115 with reference to the table. In general, the greater the thickness of the passing medium, the more the attenuation amount of the ultrasonic waves emitted by the ultrasonic transmitter 115*a* and received by the ultrasonic receiver 115*b*. Therefore, the determination module 153 can specify the thickness of the medium using the ultrasonic signal and determine the type of the conveyed medium with high accuracy. Further, in this case, since the thickness sensor 114 may be omitted, the medium conveying apparatus 100 can reduce the device cost and device weight.

Next, the setting module 152 determines whether or not the type of the medium determined by the determination module 153 is a high-load medium (step S109). The high-load medium is a medium having a certain degree of the thickness, and applying a high load on the conveyance roller during conveyance. The high-load medium is, for example, medium thicker than a PPC paper (a thick paper, a plastic card, a booklet, a passport, etc.). The high-load medium may be a medium thicker than the thick paper. When the type of the medium is not the high-load medium, the setting module 152 determines not to change the current limit value (step S110), and proceeds the process to step S113.

On the other hand, when the type of the medium is the high-load medium, the setting module 152 determines to change the current limit value (step S111). Thus, the setting module 152 determines whether or not the setting module 152 changes the current limit value, according to the type of the medium determined by the determination module 153.

Thereby, the setting module 152 can suppress that the current used by the DC motor 131 is increased, and suppress that the power consumption of the medium conveying apparatus 100 is increased when the load applied to the conveyance roller by the conveyed medium is small.

Next, the setting module 152 changes the current limit value of the DC motor 131 to the second limit value (step S112). The second limit value is a value larger than the first limit value. The second limit value is preset to a magnitude of the current so that a value acquired by adding a margin to the power consumption of the DC motor 131 when driving the DC motor 131 by the current of the magnitude, does not exceed the rated power consumption of the medium conveying apparatus 100. In particular, the second limit value is set to a value acquired by adding the magnitude (the maximum value) of the current used by the second motor 132 to the first limit value.

Next, the control module 151 stops the second motor 132, and continues to drive the DC motor 131 (step S113). That is, when the current limit value is changed to the second limit value, the control module 151 rotates the DC motor 131 to drive the first to fourth conveyance rollers 116, 117, 120 and 121 so that the magnitude of the current flowing through the coil does not exceed the second limit value, based on the second limit value.

Thus, the setting module 152 sets the current limit value of the DC motor 131 to the first limit value until the front end of the medium reaches between the first conveyance roller 116 and the second conveyance roller 117, and the imaging device 119. That is, the control module 151 drives the first conveyance roller 116 and the second conveyance roller 117 by rotating the DC motor 131 based on the first limit value, before the imaging device 119 performs imaging. Thus, the control module 151 can reduce the current used by the DC motor 131 to reduce the power consumption of the medium conveying apparatus 100, before the imaging device 119 performs imaging.

On the other hand, the setting module 152 changes the current limit value to the second limit value after the front end of the medium has reached between the first conveyance roller 116 and the second conveyance roller 117, and the imaging device 119. That is, the control module 151 drives the first conveyance roller 116 and the second conveyance roller 117 by rotating the DC motor 131 based on the second limit value, when the imaging device 119 performs imaging. Thus, the control module 151 can suppress occurrence of distortion of the medium in the input image generated by the imaging device 119, by increasing the current which the DC motor 131 can be used to stably convey the medium when the imaging device 119 performs imaging.

Further, the control module 151 rotates the second motor 132 until the front end of the medium reaches between the first conveyance roller 116 and the second conveyance roller 117, and the imaging device 119. Then, the control module 151 stops the second motor 132 after the front end of the medium has reached between the first conveyance roller 116 and the second conveyance roller 117, and the imaging device 119. Therefore, the control module 151 reduces the current used by the DC motor 131 so that the second motor 132 can consume the sufficient power instead when the feed roller 112 and the brake roller 113 feed the medium. On the other hand, the control module 151 reduces the power consumption by the second motor 132, so that the DC motor 131 can use more current to stably convey the medium instead, after the first conveyance roller 116 and the second conveyance roller 117 pinches the medium.

Next, the control module 151 causes the imaging device 119 to starts imaging the medium (step S114).

Next, the control module 151 determines whether or not the rear end of the medium has passed through the imaging device 119 (step S115). The control module 151, for example, acquires the second medium signal periodically from the second medium sensor 118, and determines whether or not the medium exists at the position of the second medium sensor 118, based on the acquired second medium signal. The control module 151 determines that the rear end of the medium has passed through the position of the second medium sensor 118 when a signal value of the second medium signal changes from a value indicating that a medium exists to a value indicating that there is no medium. The control module 151 determines that the rear end of the medium has passed through the imaging device 119 when a certain period has elapsed since the control module 151 determines that the rear end of the medium has passed through the position of the second medium sensor 118. The control module 151 waits until the rear end of the medium passes through the imaging device 119.

When the rear end of the medium passes through the imaging device 119, the control module 151 acquires an input image from the imaging device 119, and transmits the acquired input image to the information processing apparatus through the interface device 133 (step S116).

Next, the control module 151 determines whether or not the medium remains on the medium tray 103 based on the first medium signal acquired from the first medium sensor 111 (step S117). When a medium remains on the medium tray 103, the control module 151 returns the process to step S103 and repeats the processes in steps S103 to S117.

On the other hand, when the medium does not remain on the medium tray 103, the control module 151 stops the DC motor 131 (step S118), and ends the series of steps.

The processes of steps S105 to S106 may be omitted, the determination module 153 may not determine whether or not the multi-feed of the conveyed medium has occurred. Further, the processes of steps S108 to S111 may be omitted, the setting module 152 may change the current limit value to the second limit value after the front end of the medium has reached between the first conveyance roller 116 and the second conveyance roller 117, and the imaging device 119, regardless of the type of the conveyed medium. Further, similarly to processes of steps S105 to S106, the determination module 153 may determine whether or not the multi-feed has occurred, and execute the abnormal processing when the multi-feed has occurred, until the control module 151 determines that the rear end of the medium has passed through the imaging device 119 in step S115 after the control module 151 causes the imaging device 119 to start imaging in step S114.

Figure 7A:
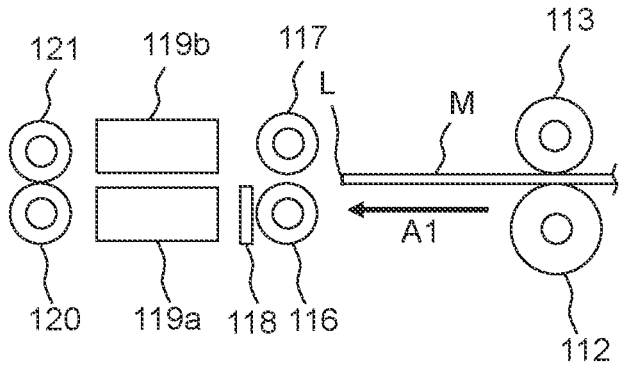
FIG. 7A is a schematic diagram for illustrating a magnitude of a torque.
Figure 7B:
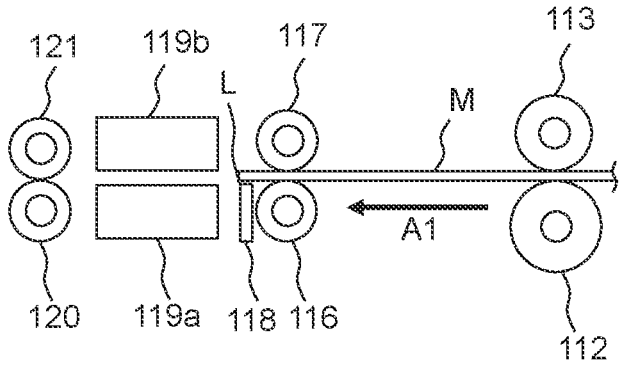
FIG. 7B is a schematic diagram for illustrating the magnitude of the torque.
Figure 7C:
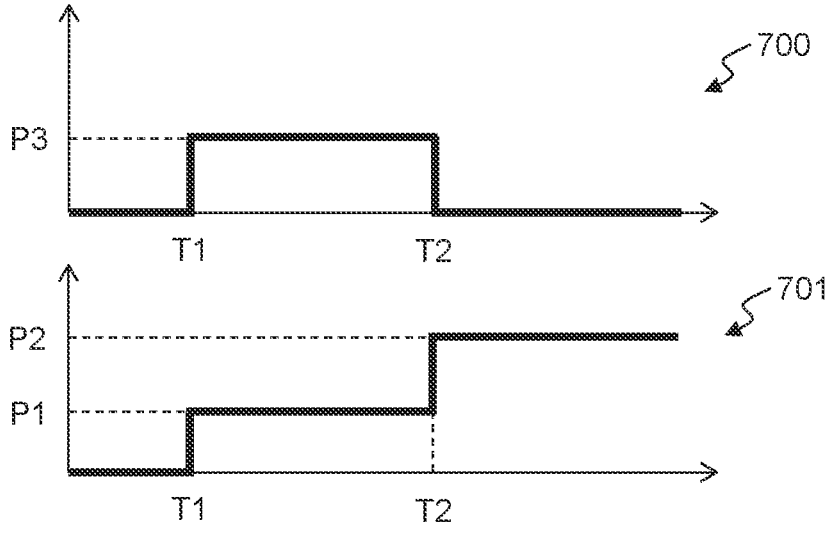
FIG. 7C is a schematic diagram for illustrating the magnitude of the torque.

FIG. 7A, FIG. 7B and FIG. 7C are schematic diagrams for illustrating the magnitude of the torque of the second motor 132 and the DC motor 131 at each timing when the medium is conveyed.

FIG. 7A shows a state in which the front end L of the medium M has reached between the feed roller 112 and the brake roller 113, and the first conveyance roller 116 and the second conveyance roller 117. FIG. 7B shows a state in which the front end L of the medium M has reached between the first conveyance roller 116 and the second conveyance roller 117, and the imaging device 119.

FIG. 7C is a graph indicating the maximum value of the torque of the second motor 132 and the DC motor 131 at each timing. Graph 700 of FIG. 7C indicates the maximum value of the torque of the second motor 132, and graph 701 of FIG. 7C indicates the maximum value of the torque of the DC motor 131. The horizontal axis of the FIG. 7C indicates the time. The vertical axis indicates the magnitude of the torque. Time T1 is the timing at which the conveyance of the medium is started. Time T2 is the timing at which the front end L of the medium M reaches between the first conveyance roller 116 and the second conveyance roller 117, and the imaging device 119. A torque P1 is the magnitude of the torque that can be generated when the current of the first limit value flows through the DC motor 131. A torque P2 is the magnitude of the torque that can be generated when the current of the second limit value flows through the DC motor 131. The torque of each motor is proportional to the magnitude of the current flowing through each motor. When the second limit value is set to a value acquired by adding the magnitude (the maximum value) of the current used by the second motor 132 to the first limit value, the torque P2 is the value acquired by adding a torque P3 of the second motor 132 to the torque P1.

As shown in FIG. 7A, the medium is fed by the feed roller 112 and the brake roller 113 until the front end L of the medium M passes through the position of the first conveyance roller 116 and the second conveyance roller 117. Therefore, even when the torque (P1) of the DC motor 131 to drive the first conveyance roller 116 and the second conveyance roller 117 is small, the medium is fed without problems. Further, when the front end L of the medium M passes through the position of the first conveyance roller 116 and the second conveyance roller 117, the rotation speed of the DC motor 131 varies by the load change when the first conveyance roller 116 and the second conveyance roller 117 pinches the medium M. However, at this time, the front end L of the medium M has not reached an imaging position of the imaging device 119, the imaging device 119 has not started imaging. Therefore, distortion, etc., is not generated in the input image generated by the imaging device 119 even when the conveying speed of the medium M varies. Therefore, the medium is conveyed without problems, until the front end L of the medium M reaches between the first conveyance roller 116 and the second conveyance roller 117, and the imaging device 119, even when the torque (P1) of the DC motor 131 is small.

As shown in FIG. 7B, the medium is conveyed by the first conveyance roller 116 and the second conveyance roller 117 after the front end L of the medium M has passed through the position of the first conveyance roller 116 and the second conveyance roller 117. Therefore, even when the current value of the current used in the second motor 132 is set to 0, and the driving of the feed roller 112 and the brake roller 113 by the second motor 132 is stopped, the medium is conveyed without problems by the first conveyance roller 116 and the second conveyance roller 117. Further, by increasing the torque (P2) of the DC motor 131 by the amount acquired by setting the current value of the current used in the second motor 132 to 0, the medium M is stably conveyed, the imaging device 119 can generate the input image in which the distortion of the medium M does not occur. Further, by setting the second limit value to a value acquired by adding the magnitude of the current used by the second motor 132 to the first limit value, the medium conveying apparatus 100 can keep the magnitude of the power consumption during the medium conveyance constant, and stably operate within the range of the rated power consumption.

As described in detail above, the medium conveying apparatus 100 increases the current limit value of the DC motor 131 when the front end of the medium has reached between the first conveyance roller 116 and the second conveyance roller 117, and the imaging device 119. Thus, the medium conveying apparatus 100 can more appropriately control the magnitude of the current used by the DC motor 131, while stably imaging the conveyed medium.

In particular, the medium conveying apparatus 100 can sufficiently increase the torque of the DC motor 131 during imaging of the medium, and stably image the medium even when the medium having a thickness as a passport is conveyed. In general, in the medium conveying apparatus for supporting the conveyance of the passport, a carrier sheet for holding and conveying the passport is used. The carrier sheet is colorless and transparent, and has a marker at the front end. The second medium sensor 118 is preferably located at a position at which the torque of the DC motor 131 is sufficiently stable, until the front end of the passport held between the carrier sheet passes through the imaging position of the imaging device 119 after the front end of the carrier sheet has passed through the second medium sensor 118, Further, the medium conveying apparatus 100 stops the feed roller 112 and the brake roller 113 after completing the feeding of the medium, but continues to rotate the first to fourth conveyance rollers 116, 117, 120 and 121 during the conveying of the medium. The medium conveying apparatus 100 can more appropriately limit the power consumption in the medium conveying apparatus 100 by driving the first to fourth transport rollers 116, 117, 120 and 121 that continue to rotate during the conveying of the medium using the DC motor 131.

The medium conveying apparatus 100 can convey a plurality of types of media having various thicknesses, including media having a plurality of regions having different thicknesses, such as a passport in an open state, using the DC motor 131 which is low cost, and suitably image the media. Therefore, the medium conveying apparatus 100 can generate an appropriate input image while reducing the equipment cost.

Figure 8:
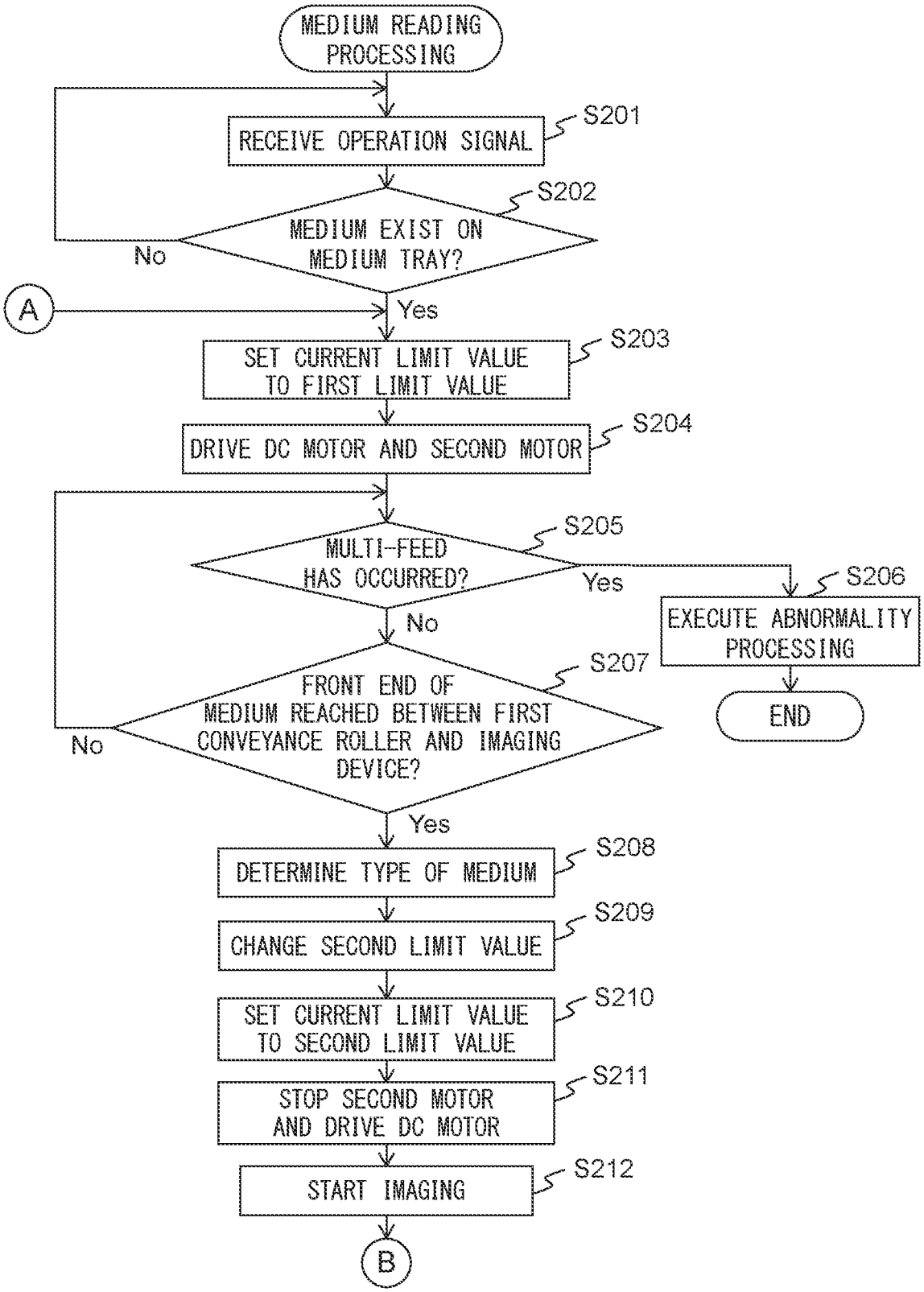
FIG. 8 is a flowchart illustrating an operation example of a part of another medium reading processing.

FIG. 8 is a flowchart illustrating an operation example of a part of the medium reading processing of the medium conveying apparatus 100 according to another embodiment.

A part of the medium reading processing illustrated in FIG. 8 is performed in place of a portion of the medium reading processing illustrated in FIG. 5. Since the processes of steps S201 to S208, S211 to S212 of the flowchart illustrated in FIG. 8 is the same as the processes of steps S101 to S108, S113 to S114 of the flowchart illustrated in FIG. 5, a detailed description thereof will be omitted. The processes of steps S209 to S210 will be described below.

In step S209, the setting module 152 changes (sets) the second limit value in according with the type of the medium determined by the determination module 153 (step S209). The medium conveying apparatus 100 stores in advance a table in which the type of the medium and the second limit value are associated with each other in the storage device 140, and the setting module 152 determines the second limit value according to the type of the medium with reference to the table. In the table, the type of the medium and the second limit value are associated with each other such that the smaller the thickness of the medium, the smaller the second limit value, and the larger the thickness of the medium, the larger the second limit value. Thus, since the setting module 152 decreases the current limit value of the DC motor 131 as the medium is thinner, the setting module 152 can suppress the power consumption of the DC motor 131. Further, since the setting module 152 increases the current limit value of the DC motor 131 and increases the torque of the first conveyance roller 116 and the second conveyance roller 117 as the medium is thicker, the setting module 152 can stably convey the medium.

Next, the setting module 152 sets the current limit value of the DC motor 131 to the second limit value changed (set) in step S209 (step S210).

As described in detail above, the medium conveying apparatus 100, even when changing the second limit value according to the type of medium, can appropriately control the magnitude of the current used by the DC motor 131.

Figure 9:
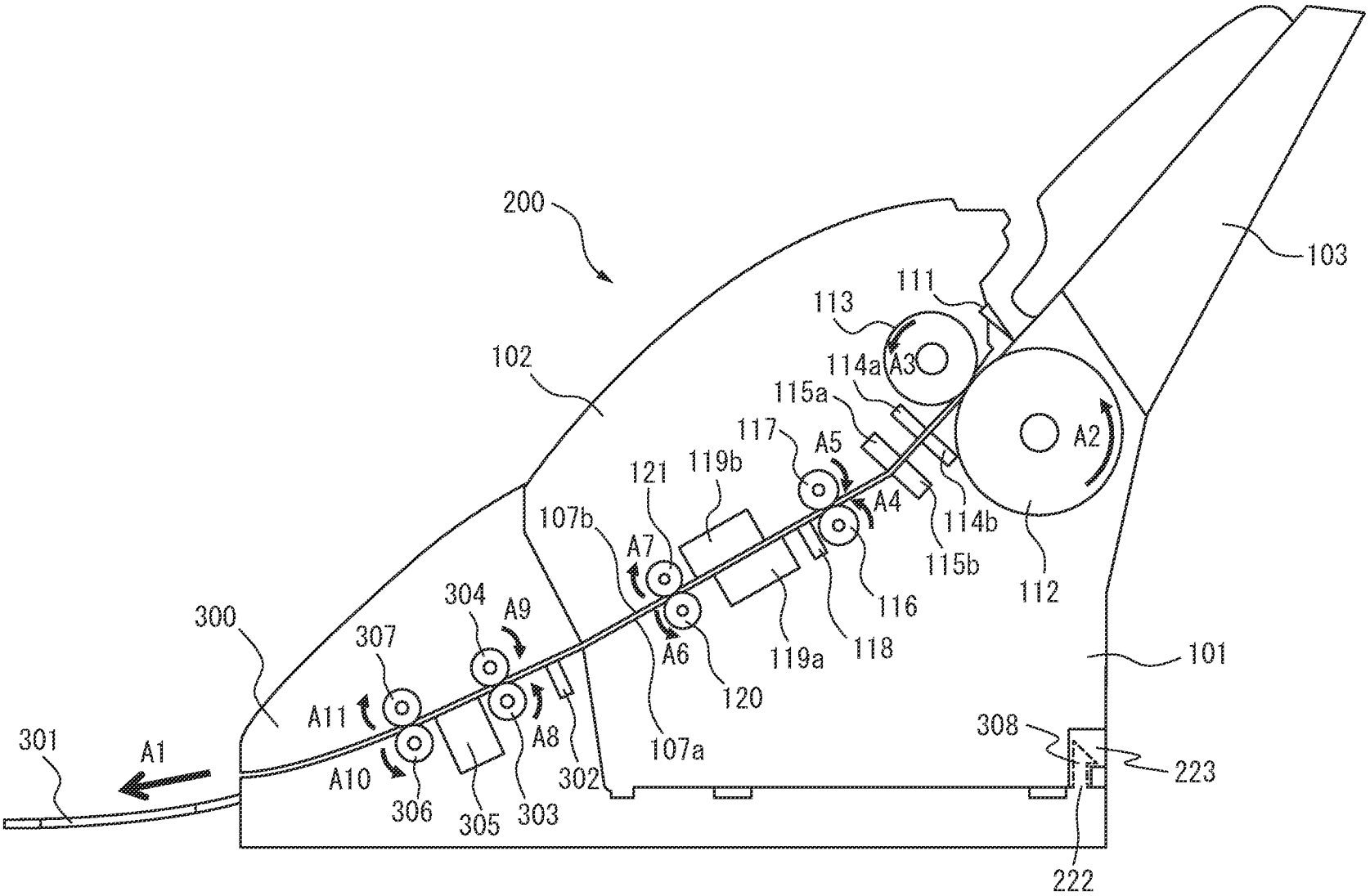
FIG. 9 is a diagram for illustrating a conveyance path inside another medium conveying apparatus 200.

FIG. 9 is a diagram for illustrating a conveyance path inside the medium conveying apparatus 200 according to another embodiment.

The medium conveying apparatus 200 includes the respective portions of the medium conveying apparatus 100 and further includes an imprinter 300. The imprinter 300 may be configured integrally with the lower housing 101 and the upper housing 102, rather than being configured separately from the lower housing 101 and the upper housing 102. In the medium conveying apparatus 200, the ejection tray 104 is removed, the lower housing 101 and the upper housing 102 are placed on the imprinter 300. The imprinter 300 is detachably engaged with the lower housing 101 and the upper housing 102. The imprinter 300 is engaged with the lower housing 101, by fitting a tab 308 provided on an upper surface of the imprinter 300 into a recess 223 through a hole 222 provided in a lower surface portion of the lower housing 101. In a state where the imprinter 300 is engaged with the lower housing 101, a medium inlet of the imprinter 300 faces the medium outlet from the lower housing 101 and the upper housing 102. The imprinter 300 prints predetermined information on the medium conveyed from the lower housing 101 and the upper housing 102.

The imprinter 300 includes a second ejection tray 301, a third medium sensor 302, a fifth conveyance roller 303, a sixth conveyance roller 304, a printing device 305, a seventh conveyance roller 306 and a eighth conveyance roller 307, etc. The number of each roller is not limited to one, and may be plural.

The second ejection tray 301 is engaged with the imprinter 300 in such a way as to be able to hold the ejected medium.

The third medium sensor 302 is located on an upstream side of the fifth conveyance roller 303 and the sixth conveyance roller 304 in the medium conveying direction A1. The third medium sensor 302 has the same configuration as the second medium sensor 118, to detect whether or not the medium exists at the position. The third medium sensor 302 includes a light emitter, a light receiver and a reflecting member, to generate and output a third medium signal being an electrical signal corresponding to the intensity of the light received by the light receiver, which is emitted by the light emitter, and reflected by the reflecting member.

The fifth conveyance roller 303 and the sixth conveyance roller 304 are located to face each other. The fifth conveyance roller 303 and the sixth conveyance roller 304 are examples of a second roller, and are located on a downstream side of the imaging device 119 and on an upstream side of the printing device 305 in the medium conveying direction A1. The fifth conveyance roller 303 and the sixth conveyance roller 304 conveys the medium imaged by the imaging device 119, and conveyed by the third conveyance roller 120 and the fourth conveyance roller 121 to the printing device 305.

The printing device 305 is an example of a printing device, and is located on a lower side of the medium conveyance path so as to be printable on the surface of the conveyed medium, and prints predetermined information on the surface of the conveyed medium. The printing device 305 prints information such as characters designated by a user using the information processing apparatus. The printing device 305 is an ink jet type printer having a printer head in which a plurality of ink injection ports are formed, and prints the predetermined information on the medium by injecting ink onto the medium passing through the position of the printing device 305.

The printing device 305 may be provided to print on the back surface of the conveyed medium. Alternatively, printing device 305 may be provided to print on both the front surface and the back surface of the conveyed medium. The printing device 305 may be a printer other than an inkjet type, such as a laser type.

The medium read by the imaging device 119, and conveyed by the third conveyance roller 120 and the fourth conveyance roller 121, is fed to the position of the printing device 305 by the fifth conveyance roller 303 and the sixth conveyance roller 304 rotating in directions of an arrow A8 and an arrow A9, respectively. The medium printed by the printing device 305 is ejected onto the second ejection tray 301 by the seventh conveyance roller 306 and the eighth conveyance roller 307 rotating in directions of an arrow A10 and an arrow A11, respectively.

Figure 10:
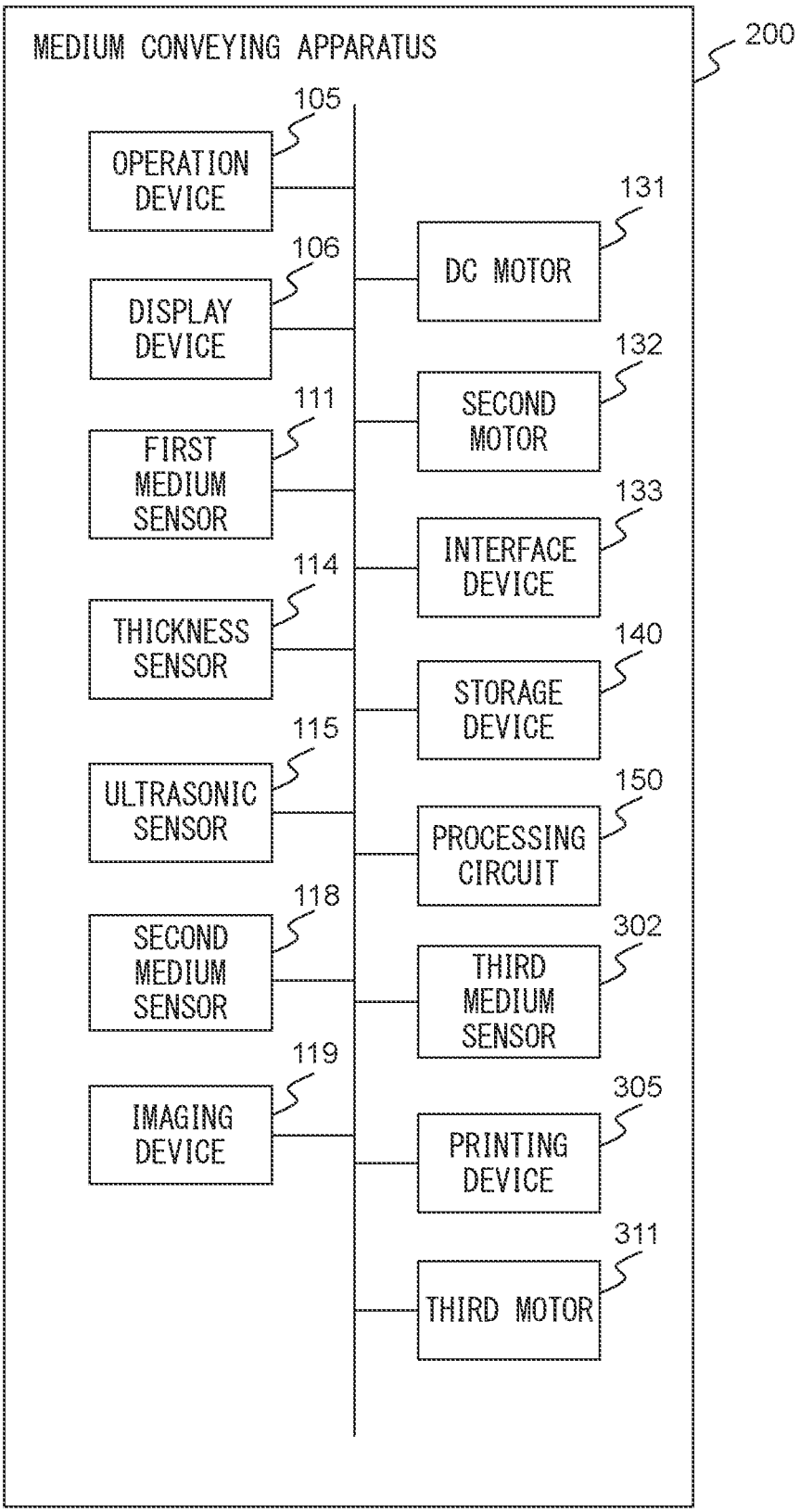
FIG. 10 is a block diagram illustrating a schematic configuration of the medium conveying apparatus 200.

FIG. 10 is a block diagram illustrating a schematic configuration of the medium conveying apparatus 200.

The medium conveying apparatus 200 further includes a third motor 311, etc., in addition to the respective portions of the medium conveying apparatus 100 and the configuration described above.

The third motor 311 drives and rotates the fifth to eighth conveyance rollers 303, 304, 306 and 307 by the control signal from the processing circuit 150 to convey the medium. The third motor 311 is a stepping motor. The third motor 311 may be a DC motor. The fifth to eighth conveyance rollers 303, 304, 306 and 307 may also be driven by separate motors.

Figure 11:
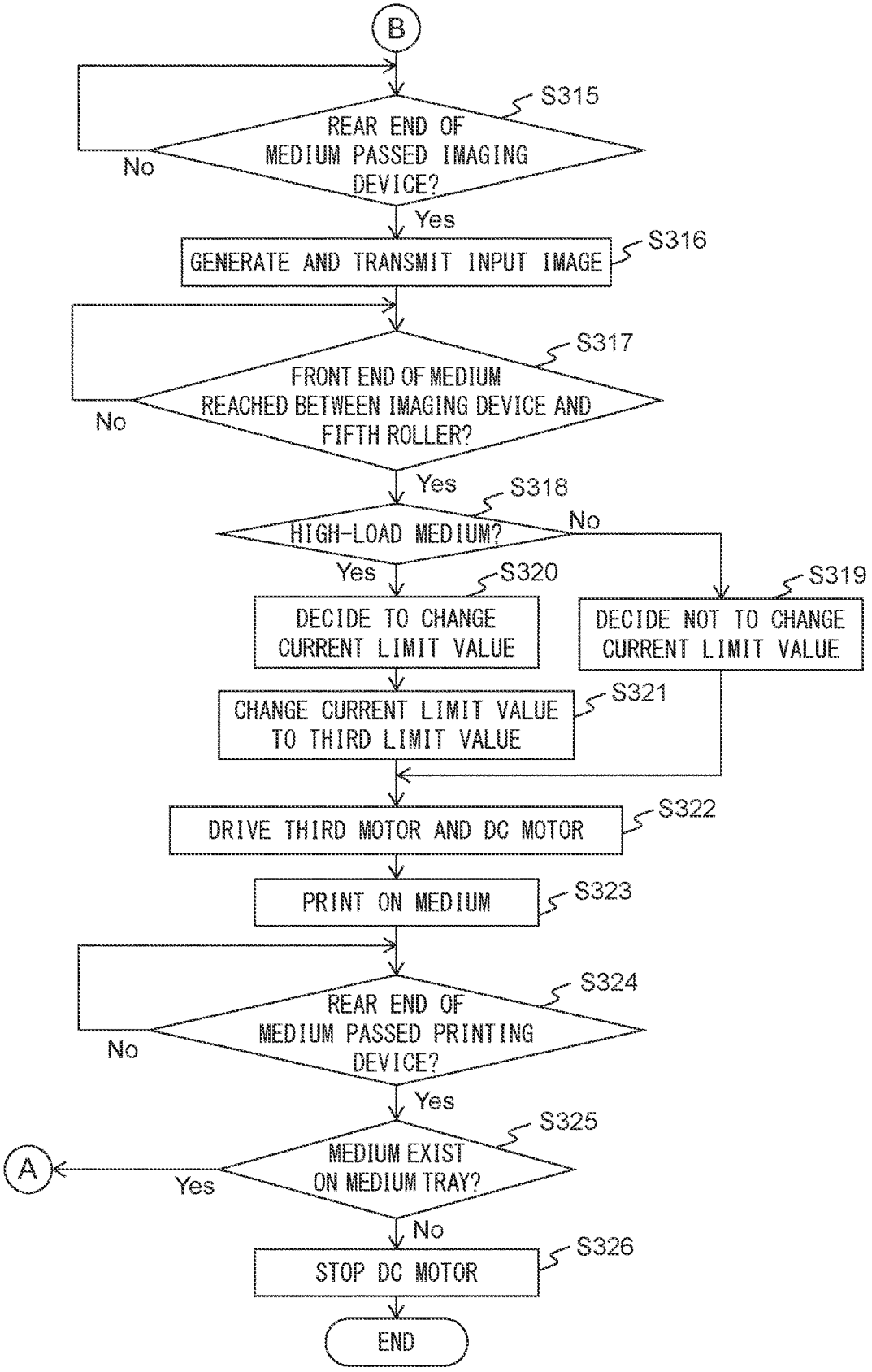
FIG. 11 is a flowchart illustrating an operation example of a part of another medium reading processing.

FIG. 11 is a flowchart illustrating an operation example of a part of the medium reading processing of the medium conveying apparatus 200.

A part of the medium reading processing illustrated in FIG. 11 is performed in place of a part of the medium reading processing illustrated in FIG. 6. Since the processes of steps S315 to S316, S325 to S326 of the flowchart illustrated in FIG. 11 is the same as the processes of steps S115 to S116, S117 to S118 of the flowchart illustrated in FIG. 6, a detailed description thereof will be omitted. The processes of steps S317 to S324 will be described below.

In step S317, the detection module 154 determines whether or not the front end of the medium has reached between the imaging device 119, and the fifth conveyance roller 303 and the sixth conveyance roller 304 (step S317). The detection module 154 acquires the third medium signal periodically from the third medium sensor 302, and determines whether or not the medium exists at the position of the third medium sensor 302, based on the acquired third medium signal. The detection module 154 determines that the front end of the medium has reached between the imaging device 119, and the fifth conveyance roller 303 and the sixth conveyance roller 304 when a signal value of the third medium signal changes from a value indicating that there is no medium to a value indicating that a medium exists. Thus the detection module 154 detects the front end of the medium reaches between the imaging device 119, and the fifth conveyance roller 303 and the sixth conveyance roller 304.

The detection module 154 may determine that the front end of the medium has reached between the imaging device 119, and the fifth conveyance roller 303 and the sixth conveyance roller 304 when a predetermined time has elapsed since the front end of the medium has passed through the position of the second medium sensor 118 or the thickness sensor 114. Alternatively, the detection module 154 may determine that the front end of the medium has reached between the imaging device 119, and the fifth conveyance roller 303 and the sixth conveyance roller 304 when a predetermined time has elapsed since the start of feeding of the medium. The detection module 154 waits until the front end of the medium reaches between the imaging device 119, and the fifth conveyance roller 303 and the sixth conveyance roller 304.

On the other hand, when the front end of the medium has reached between the imaging device 119, and the fifth conveyance roller 303 and the sixth conveyance roller 304, the setting module 152 determines whether or not the type of the medium determined by the determination module 153 in step S108 is the high-load medium (step S318).

When the type of the medium is not the high-load medium, the setting module 152 determines not to change the current limit value (step S319), and proceeds the process to step S321.

On the other hand, when the type of the medium is the high-load medium, the setting module 152 determines to change the current limit value (step S320).

Next, the setting module 152 changes the current limit value of the DC motor 131 to the third limit value (step S321). The third limit value is smaller than the second limit value. The third limit value is preset to a magnitude of the current so that a value acquired by adding a margin to a sum of a power consumption of the DC motor 131 and a power consumption of the third motor 311 when driving the DC motor 131 by the current of the magnitude, does not exceed a rated power consumption of the medium conveying apparatus 200. In particular, the third limit value is set to a value acquired by subtracting the magnitude (maximum value) of the current used by the third motor 311 from the second limit value.

Next, the control module 151 drives and rotates the third motor 311 and rotates the fifth to eighth conveyance rollers 303, 304, 306 and 307 to convey the medium, and continues to drive the DC motor 131 (step S322). That is, when the current limit value is changed to the third limit value, the control module 151 rotates the DC motor 131 to drive the first to fourth conveyance rollers 116, 117, 120 and 121 so that the magnitude of the current flowing through the coil does not exceed the third limit value, based on the third limit value.

Thus, the setting module 152 changes the current limit value to the third limit value while rotating the third motor 311, after the front end of the medium has reached between the imaging device 119, and the fifth conveyance roller 303 and the sixth conveyance roller 304. That is, the control module 151 rotates the DC motor 131 based on the third limit value to drive the first conveyance roller 116 and the second conveyance roller 117 when rotating the third motor 311 to convey the medium to the printing device 305. Therefore, the control module 151 can stably operate within the range of the rated power consumption, by reducing the current which can be used by the DC motor 131, to keep the magnitude of the power consumption of the medium conveying apparatus 200 constant when rotating the third motor 311. When the fifth conveyance roller 303 and the sixth conveyance roller 304 convey the medium, the medium is stably conveyed by the fifth conveyance roller 303 and the sixth conveyance roller 304 even when the torque by the first to fourth conveyance rollers 116, 117, 120 and 121 is reduced.

Next, the control module 151 waits for a predetermined time until the printing position of the medium is conveyed to the position of the printing device 305, and causes the printing device 305 to print the predetermined information on the conveyed medium (step S323).

Next, the control module 151 determines whether or not the rear end of the medium has passed through the printing device 305 (S324 of steps). The control module 151, for example, acquires the third medium signal periodically from the third medium sensor 302, and determines whether or not the medium exists at the position of the third medium sensor 302, based on the acquired third medium signal. The control module 151 determines that the rear end of the medium has passed through the position of the third medium sensor 302 when the signal value of the third medium signal changes from a value indicating that a medium exists to a value indicating that there is no medium. The control module 151 determines that the rear end of the medium has passed through the printing device 305 when a certain period has elapsed since the control module 151 determines that the rear end of the medium has passed through the position of the third medium sensor 302. The control module 151 waits until the rear end of the medium passes through the printing device 305 and proceeds the process to step S325 when the rear end of the medium has passed through the printing device 305.

The processes of steps S318 to S320 may be omitted, the setting module 152 may change the current limit value to the third limit value, after the front end of the medium has reached between the imaging device 119, and the fifth conveyance roller 303 and the sixth conveyance roller 304, regardless of the type of the conveyed medium.

Further, the processes similar to the processes of steps S208 to S210 of FIG. 8 may be executed, instead of the processes of steps S318 to S321, the setting module 152 may change the third limit value according to the type of the medium. In that case, the medium conveying apparatus 100 stores in advance a table in which the type of the medium and the third limit value are associated with each other in the storage device 140, and the setting module 152 determines the third limit value according to the type of the medium with reference to the table. In the table, the type of the medium and the third limitation value are associated with each other such that the smaller the thickness of the medium, the smaller the third limit value, and the larger the thickness of the medium, the larger the third limit value. Thus, the setting module 152 decreases the current limit value of the DC motor 131 as the medium is thinner, and can suppress the power consumption of the DC motor 131. Further, since the setting module 152 increases the current limit value of the DC motor 131 and increases the torque of the first conveyance roller 116 and the second conveyance roller 117 as the medium is thicker, the setting module 152 can stably convey the medium.

As described in detail above, the medium conveying apparatus 200 can more appropriately control the magnitude of the current used by the DC motor 131 even when driving the fifth conveyance roller 303 and the sixth conveyance roller 304 by the third motor 311.

Figure 12:
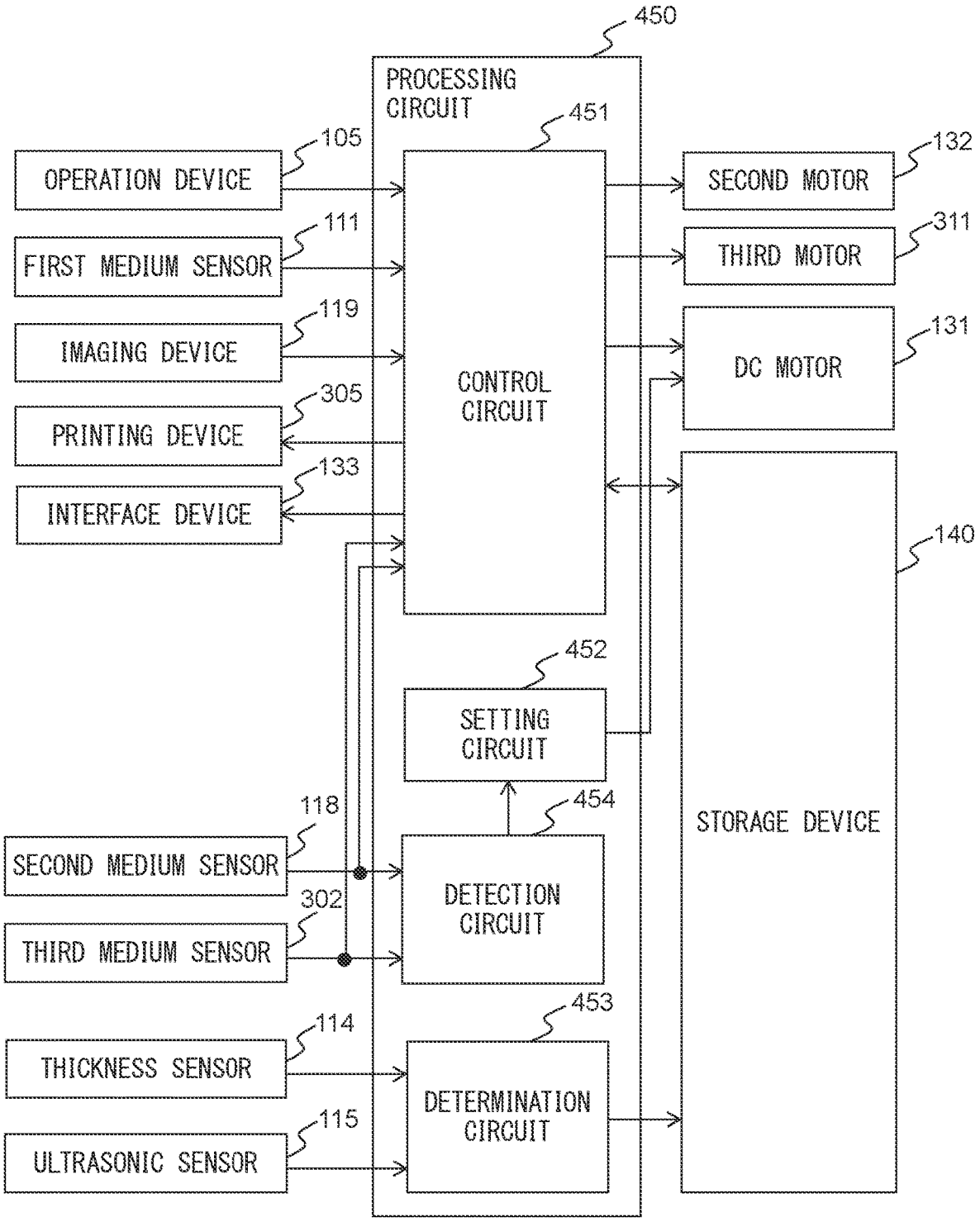
FIG. 12 is a diagram illustrating a schematic configuration of another processing circuit 450.

FIG. 12 is a diagram illustrating a schematic configuration of a processing circuit 450 in a medium conveying apparatus according to another embodiment. The processing circuit 450 is used in place of the processing circuit 150 of the medium conveying apparatus 100 or the medium conveying apparatus 200 and executes the medium read process, in place of the processing circuit 150. The processing circuit 450 includes a control circuit 451, a setting circuit 452, a determination circuit 453 and a detection circuit 454, etc. Note that each unit may be configured by an independent integrated circuit, a microprocessor, firmware, etc.

The control circuit 451 is an example of a control module and has a function similar to the control module 151. The control circuit 451 receives the operation signal from the operation device 105, the first medium signal from the first medium sensor 111, the second medium signal from the second medium sensor 118, and the third medium signal from the third medium sensor 302, and reads a determination result of the type of the medium from the storage device 140. The control circuit 451 outputs the control signal to the DC motor 131, the second motor 132 and the third motor 311 so as to control the conveyance of the medium according to the received respective signals and the read determination result. Further, the control circuit 451 receives the input image from the imaging device 119, and transmits it to the information processing apparatus through the interface device 133. Further, the control circuit 451 outputs a control signal instructing printing on the medium to the printing device 305.

The setting circuit 452 receives a change instruction to change the current limit value of the DC motor 131 from the detection circuit 454, to change the current limit value of the DC motor 131.

The determination circuit 453 receives the thickness signal from the thickness sensor 114 and the ultrasonic signal from the ultrasonic sensor 115, determines the type of the medium according to each received signal, and stores the determination result in the storage device 140.

The detection circuit 454 receives the second medium signal from the second medium sensor 118, the third medium signal from the third medium sensor 302, and outputs the change instruction to change the current limit value of the DC motor 131 to the setting circuit 452, according to the received respective signals.

As described in detail above, the medium conveying apparatus can more appropriately control the magnitude of the current used by the DC motor 131 even when using the processing circuit 450.

According to embodiments, the medium conveying apparatus, the control method and the control program can more appropriately control the magnitude of the current used by the DC motor, in the medium conveying apparatus to convey the medium using the DC motor.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:
a conveyance roller to convey a medium;
an imaging device to image the medium;
a motor to drive the conveyance roller;
a sensor to detect a front end of the medium; and
a processor to increase a current upper limit value of the motor based on a signal output from the sensor, wherein
the motor is a DC motor.

2. The medium conveying apparatus according to claim 1, wherein the processor determines whether a front end of the medium reaches between the conveyance roller and the imaging device, based on the signal output from the sensor.

3. The medium conveying apparatus according to claim 1, wherein the sensor is located between the conveyance roller and the imaging device.

4. The medium conveying apparatus according to claim 1, wherein the processor drives the conveyance roller by rotating the motor based on the increased current upper limit value when the imaging device performs imaging.

5. A medium conveying apparatus comprising:
a first roller;
a first motor to drive the first roller;
a second roller;
a second motor to drive the second roller;
an imaging device to image the medium;
a sensor to detect a front end of the medium; and
a processor to change a current limit value of the first motor with a current value of the second motor based on a signal output from the sensor.

6. The medium conveying apparatus according to claim 5, wherein the first motor is a DC motor.

7. The medium conveying apparatus according to claim 5, wherein the processor determines whether a front end of the medium reaches between the first roller and the imaging device, based on the signal output from the sensor.

8. The medium conveying apparatus according to claim 5, wherein the sensor is located between the first roller and the imaging device.

9. The medium conveying apparatus according to claim 5, further comprising a thickness sensor to detect a thickness of the conveyed medium, wherein the processor determines whether to change the current limit value, based on the thickness of the medium detected by the thickness sensor.

10. The medium conveying apparatus according to claim 5, further comprising a thickness sensor to detect a thickness of the conveyed medium, wherein the processor changes the current limit value, based on the thickness of the medium detected by the thickness sensor.

11. The medium conveying apparatus according to claim 5, further comprising an ultrasonic sensor to generate an ultrasonic signal, wherein the processor determines whether to change the current limit value, based on the ultrasonic signal.

12. The medium conveying apparatus according to claim 5, further comprising an ultrasonic sensor to generate an ultrasonic signal, wherein the processor changes the current limit value, based on the ultrasonic signal.

13. The medium conveying apparatus according to claim 5, further comprising:
a printing device to print on the medium;
a third roller to convey the medium imaged by the imaging device to the printing device;
a third motor to drive the third roller, wherein
the processor further changes the current limit value after the front end of the medium has reached between the imaging device and the third roller.

14. A medium conveying apparatus comprising:
a conveyance roller to convey a medium;
an imaging device to image the medium;
a motor to drive the conveyance roller;
a processor to determine whether a front end of the medium reaches between the conveyance roller and the imaging device, based on a time elapsed after a start of feeding the medium, set a current limit value of the motor to a first limit value until the front end of the medium reaches between the conveyance roller and the imaging device, and change the current limit value to a second limit value larger than the first limit value after the front end of the medium has reached between the conveyance roller and the imaging device, and drive the conveyance roller by rotating the motor based on the second limit value when the imaging device performs imaging.

15. The medium conveying apparatus according to claim 14, further comprising:

a feed roller provided on an upstream side of the conveyance roller in a medium conveying direction; and a second motor to drive the feed roller, and wherein the processor rotates the second motor until the front end of the medium reaches between the conveyance roller and the imaging device, and stops the second motor after the front end of the medium has reached between the conveyance roller and the imaging device.

16. The medium conveying apparatus according to claim 14, further comprising a thickness sensor to detect a thickness of the conveyed medium, wherein the processor changes the second limit value, based on the thickness detected by the thickness sensor.

17. The medium conveying apparatus according to claim 14, further comprising an ultrasonic sensor to generate an ultrasonic signal, wherein the processor changes the second limit value, based on the ultrasonic signal.

18. A medium conveying apparatus comprising:

a conveyance roller to convey a medium;

an imaging device to image the medium;

a motor to drive the conveyance roller;

a sensor to detect a front end of the medium; and a processor to increase a current upper limit value of the motor based on a signal output from the sensor, wherein the processor drives the conveyance roller by rotating the motor based on the increased current upper limit value when the imaging device performs imaging.

19. The medium conveying apparatus according to claim 18, wherein the processor determines whether a front end of the medium reaches between the conveyance roller and the imaging device, based on the signal output from the sensor.

20. The medium conveying apparatus according to claim 18, wherein the sensor is located between the conveyance roller and the imaging device.

* * * * *